US006015306A

United States Patent [19]

Jen

[11] Patent Number: 6,015,306

[45] Date of Patent: Jan. 18, 2000

[54] SHUTTER STRUCTURE OF APERTURE

[76] Inventor: Tsang Lan Jen, No. 1, Lane 199, Sec. 1, Min Chuan Rd., Tainan, Taiwan

[21] Appl. No.: 08/944,097

[22] Filed: Sep. 30, 1997

[51] Int. Cl.[7] ..... H01R 13/44

[52] U.S. Cl. ..... 439/139

[58] Field of Search ..... 439/139, 92, 143, 439/135–138

[56] References Cited

U.S. PATENT DOCUMENTS 5,746,612 5/1998 Chien-Yuan ..... 439/139

*Primary Examiner*—Steven L. Stephan
*Assistant Examiner*—Eugene G. Byrd
*Attorney, Agent, or Firm*—Rosenberg, Klein & Lee

[57] ABSTRACT

The present invention relates to a shutter structure of aperture, which includes a base, a shutter, a spring, upper shell. Wherein the shutter has several lugs on the top coordinating to the sockets, and a shaft barrel extending down from the center of the bottom side, on said lugs a projection is formed on each lug end for inserting into the socket; the base has a thimble at the center bottom; for achieving pivot of the shutter as the plug plugging in normal way, an indexing mechanism consisting of two sets of beveled guide teeth are built on the inside of the thimble of the base and the bottom end of the shaft barrel of the shutter separately and oppositely; for locking the shutter as the lugs receiving an unbalance pressing force, a locking device consisting of a set of axial ribs and a set of chamfers are built on the shaft of shaft barrel and the inside wall of the thimble so that they are in disengaging state in the normal time, and they engages together as one pressing force exerting on one lug to lock the shutter.

4 Claims, 14 Drawing Sheets

SHUTTER STRUCTURE OF APERTURE

BACKGROUND OF THE INVENTION (1) Field of the Invention

The present invention relates to a shutter structure of aperture, and more particularly to a safety doors blocking on the open ends of the sockets of aperture to prevent any foreign objects from intruding into any socket unexpectedly in normal idle time.

(2) Description of Prior Art

Referring to prior patents of U.S. Pat. No. 3,980,372 and UK patent 2,209,888, among which the U.S. Pat. No. 3,980,372, the shutter door blocking from inside of the open ends of the sockets can not stop a single metal stick or other similar objects breaks in the socket 3 or 4 through the door by pressing down the tilt 9' or 10' at the open 15 or 16; under similar circumstances, the UK patent 2,209,888 is not able to solve the problem—'single inserter opening the shutter door'.

OBJECTS AND SUMMARY OF THE INVENTION

It is therefore an object of this invention to provide a shutter structure of aperture that can be open just merely by plugging a common plug with the all plunge pins into the sockets on the aperture normally and synchronously.

The present invention include a base, a shutter, a spring, and an upper shell. Wherein the shutter has several lugs on the top portion co-ordinating to the sockets, and a barrel extending down from the centre portion of the bottom side, a projection is formed on each lug end for inserting into the socket; the base has a thimble at the centre bottom portion; for achieving pivot of the shutter as the plug plugging in normal way, an indexing mechanism consisting of two sets of beveled guide teeth are built on the inside of the thimble of the base and the bottom end of the barrel of the shutter respectively and opposingly; for locking the shutter as the lugs receiving an unbalanced pressing force, a locking device consisting of a set of axial ribs and a set of chamfers are built on the shaft of barrel and the inside wall of the thimble so that they are in disengaging state in normal time, and they engages together as one pressing force exerting on one lug to lock the shutter.

DETAILED DESCRIPTION OF PREFERRED EMBODIMENTS

Figure 1:
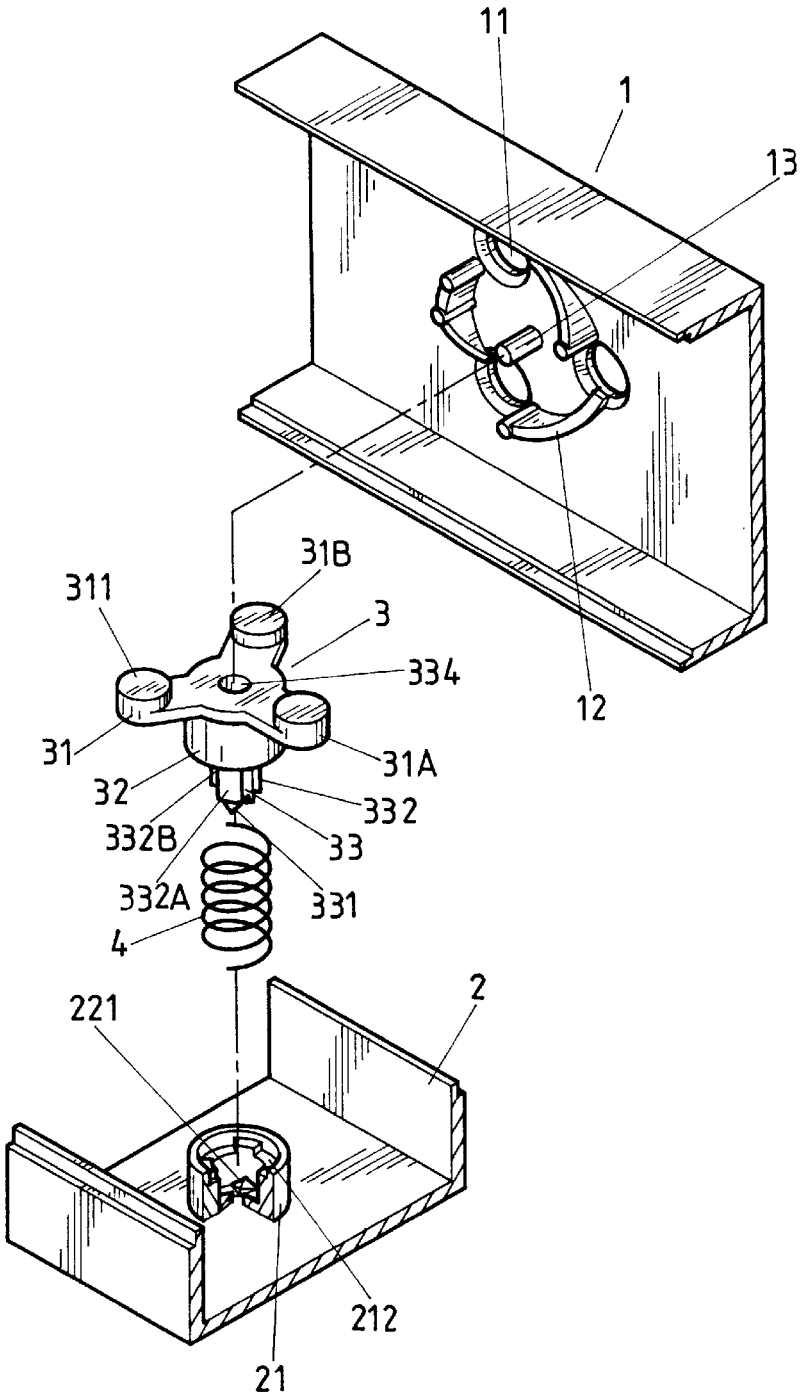
FIG. 1 is an exploded view of the present invention.
Figure 2:
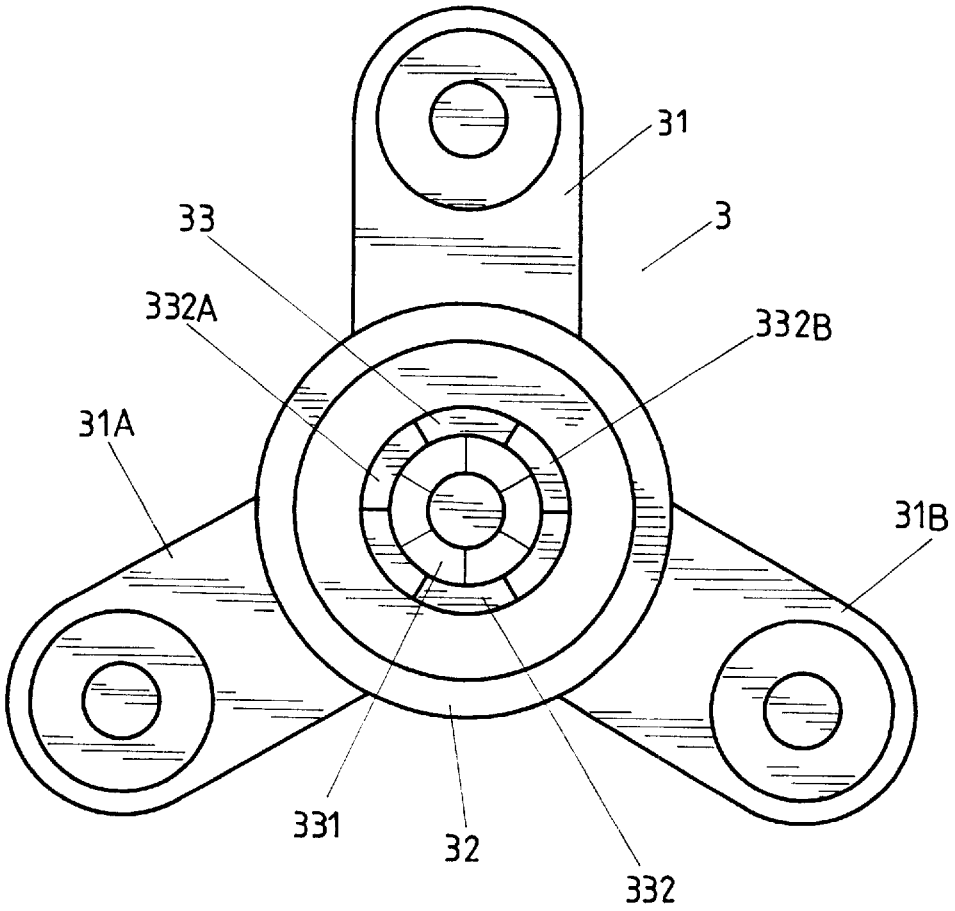
FIG. 2 is a bottom view showing the shutter of the present invention.

Referring to FIG. 1 and FIG. 2, the present invention includes an upper shell 1, a base 2, a shutter 3, a spring 4 and conducting strips 6, co-operating with a plug 5 with desired conducting pins 51 in using.

The upper shell 1 has several sockets 11 formed on the top side, a curved beveled guide plate 12 next to the inner side edge of the socket 11, and a guide pin 13 formed thereon.

The base 2 has a thimble 21 at the centre portion of the inner top side, and a set of axial beveled guide teeth 211 formed on the inside of the thimble 21, and several chamfers 212 formed on the inside rim of the thimble 21.

The shutter 3 has several lugs 31, 31A and 31B co-ordinating to the sockets, and a projection 311 moulded on the top side of the end of each lug 31 or 31A or 31B respectively, and a hollow cylinder 32 extending down from the centre bottom side with a shaft barrel 33 stretching out from the inner rim, corresponding to the lugs 31, 31A, and 31B, several beveled guide teeth 331 formed on the free end of the shaft barrel 33, and several strip ribs 332, 332A and 332B formed on the outside wall of the shaft barrel 33 axially opposite each lug 31 or 31A or 31B, and a guiding hole 334 at the centre top side.

Figure 3:
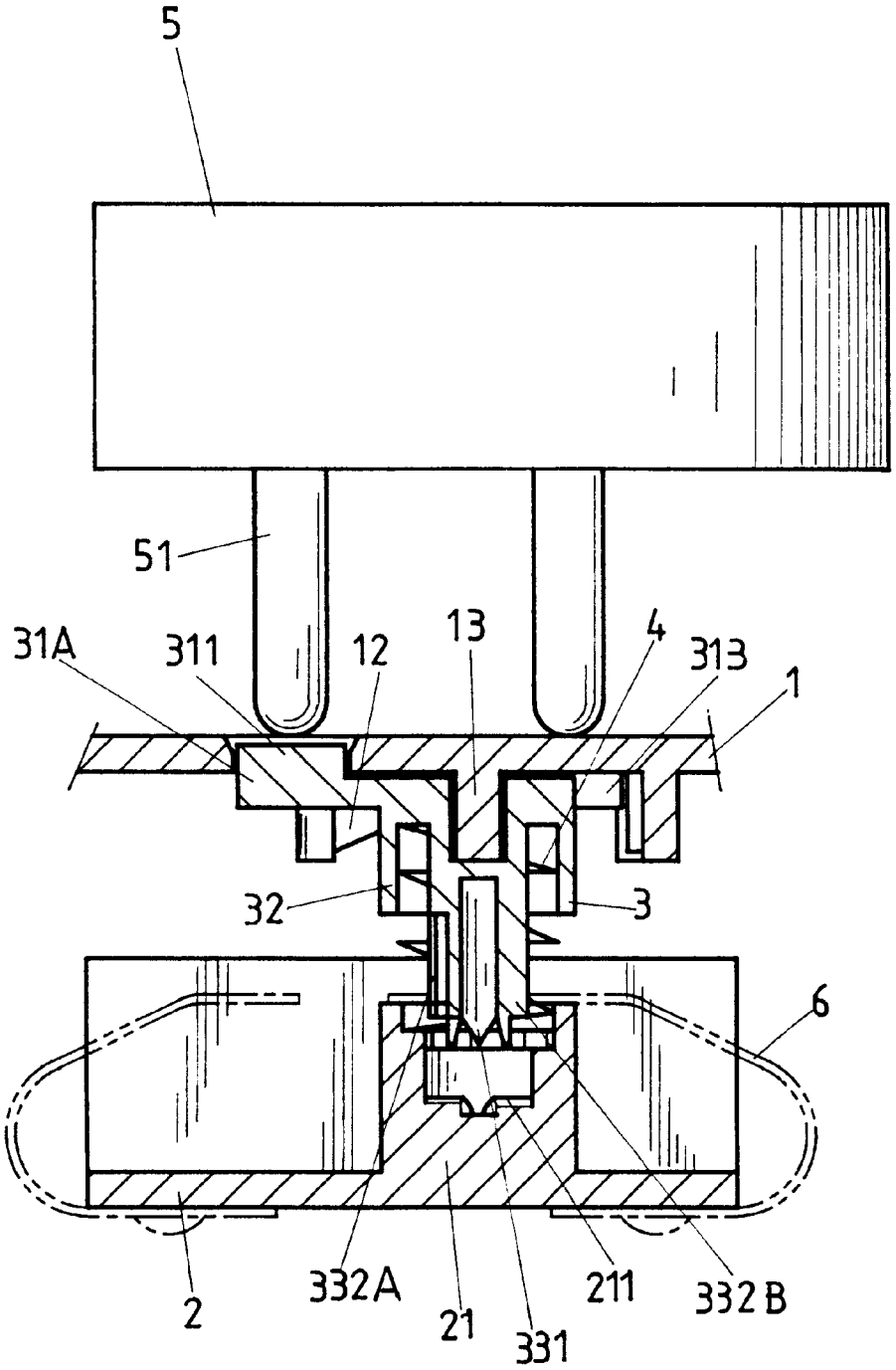
FIG. 3 is a cross-section view of the present invention.
Figure 4:
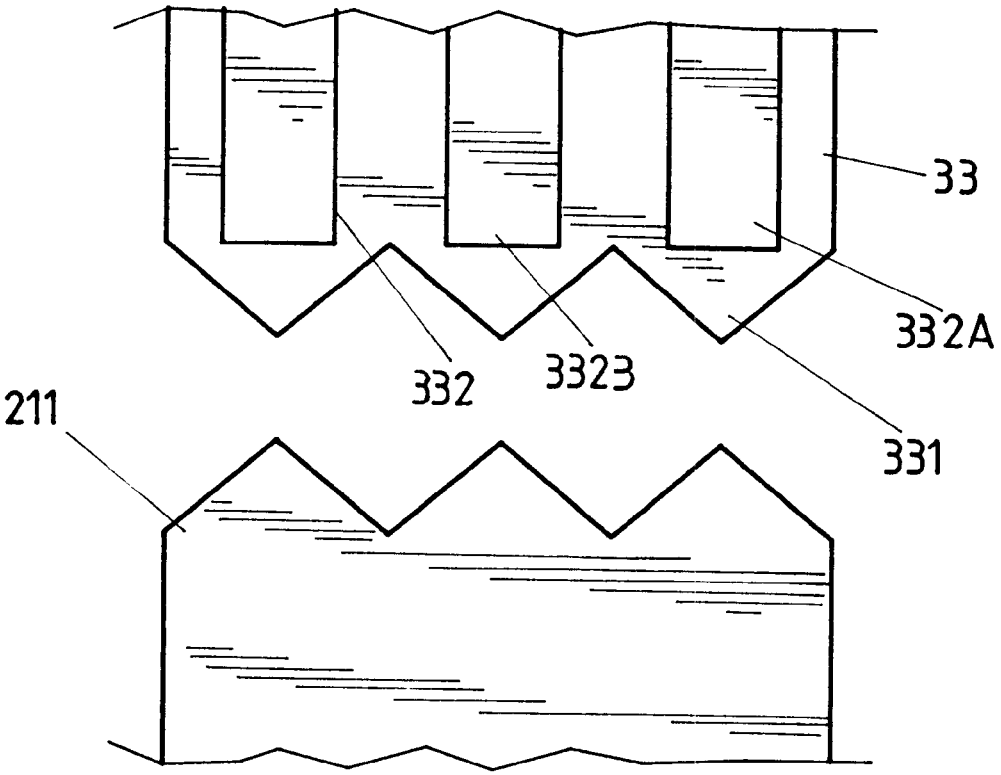
FIG. 4 is a part expended view of the present invention.
Figure 5:
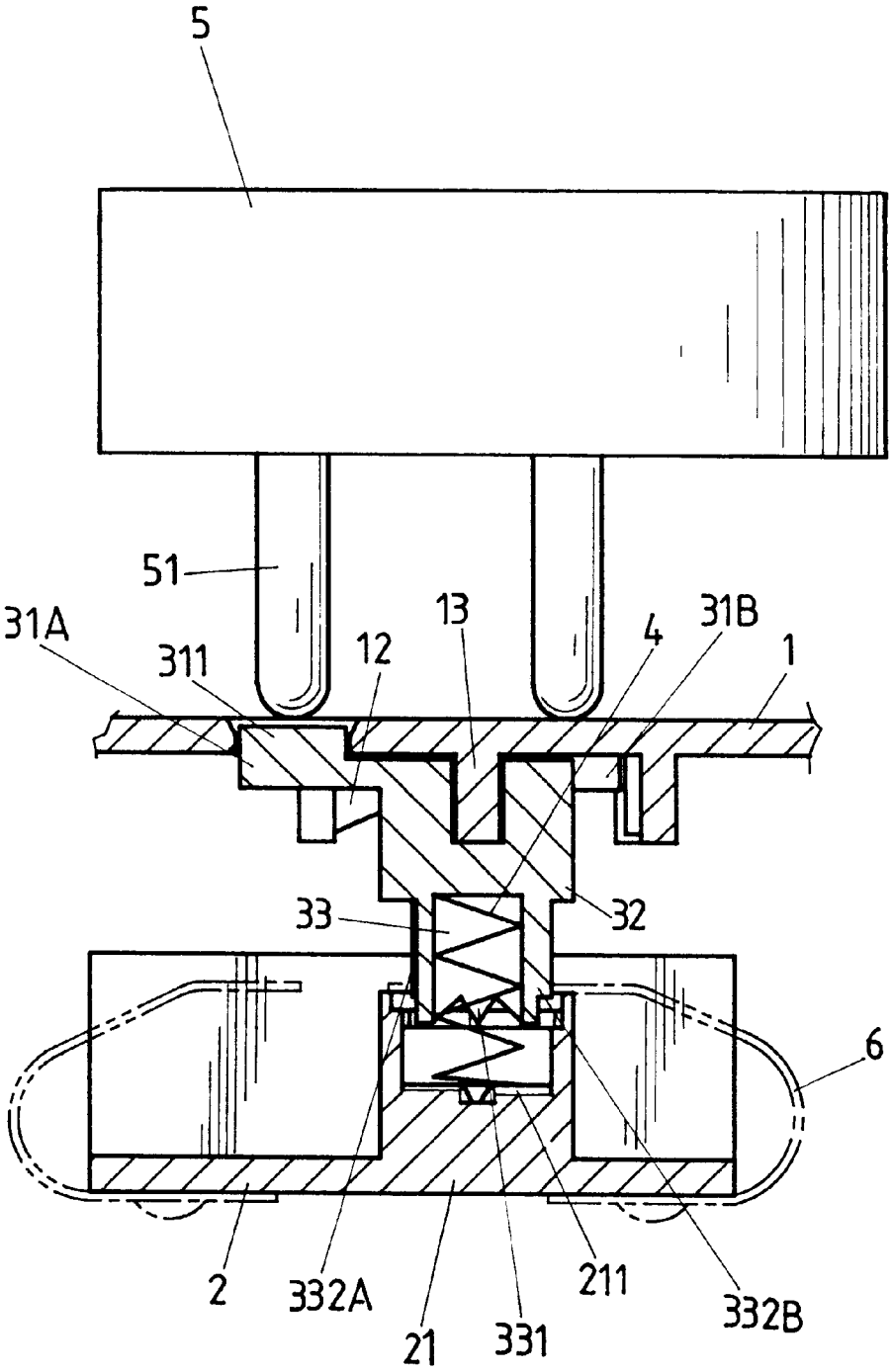
FIG. 5 is a cross-section view showing an operation of the present invention.

In combating, referring to FIG. 3 and FIG. 4, the spring 4 is put into the thimble 21 of the base 2 and the hollow cylinder 32 of the shutter 3 so that the beveled guide teeth 211 and 331 are in peak to peak opposing each other; or as shown on FIG. 5, the spring 4 is put into the shaft barrel 33 and the inside of the beveled guide teeth 211 of the base 2; then covering the upper shell 1 so that the shutter 3 is pushed up by the spring 4 to touch against the upper shell 1 and the lugs 31, 31A, and 31B block on the corresponding sockets 11 respectively with the projections 311.

Figure 6:
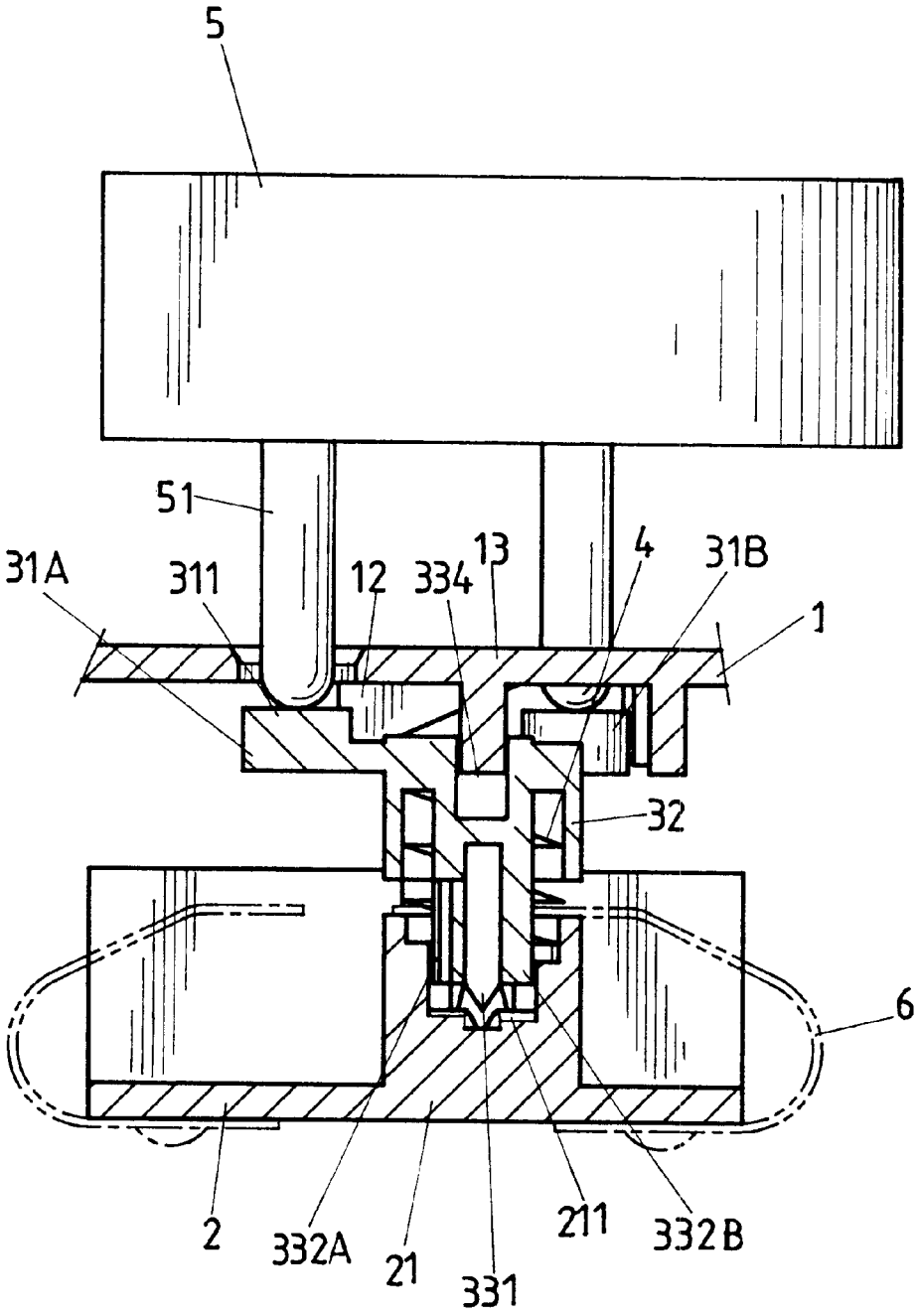
FIG. 6 is a cross-section view showing an action of the present invention.
Figure 7:
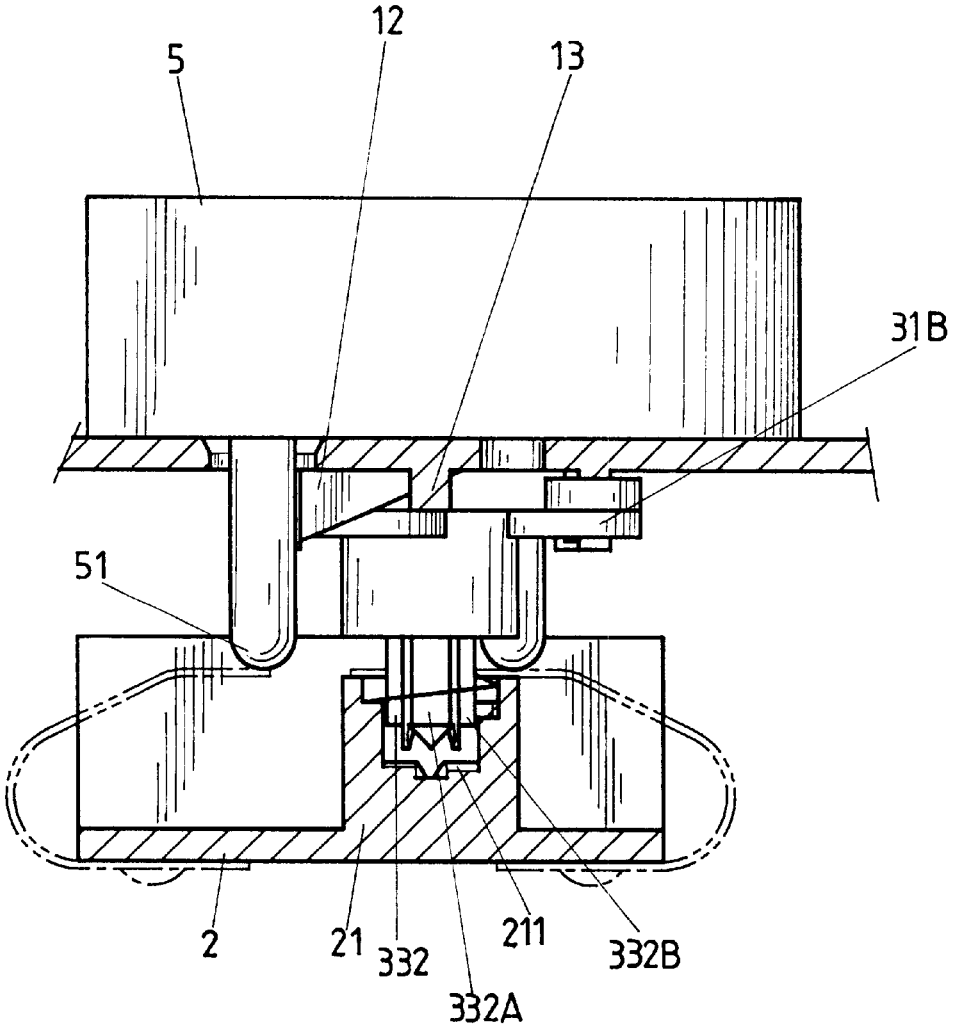
FIG. 7 is a cross-section view showing the action (1) of the present invention.

In practising, referring to FIG. 6 and FIG. 7, when the plug 5 is plugged into the sockets 11 in regular way, the conducting pins 51 press on the projections 311 of the shutter 3 synchronously to move the shutter 3 down vertically, when the peaks of the beveled guide teeth 331 touch against the bevel of the beveled guide teeth 211 of the base 2, it will slide along the bevel surface to turn the shutter 3 in an angle so that the plugging way of the plug 5 is voided, and the conducting pins 51 can get to the conducting strips 6 easily, meanwhile the spring 4 pushes the shutter 3 up to press against the curved beveled guide plates 12. When the plug 5 is pulled out, the restore force of the spring 4 will push the shutter 3 sliding on the bevel to turn an angle pivoting on the guide pin 13 until coming back to the original position again automatically.

Figure 8:
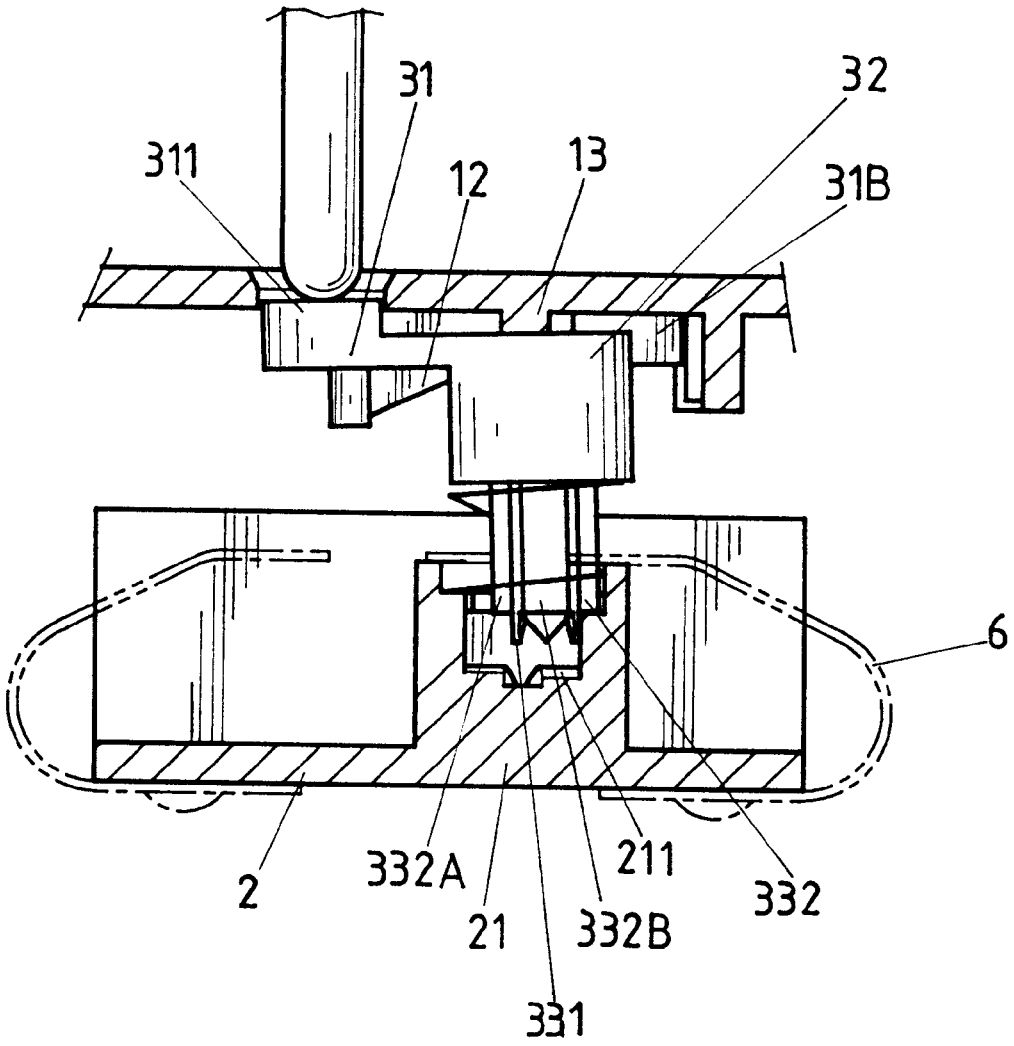
FIG. 8 is a cross-section view showing the action (2) of the present invention.

Referring to FIG. 8, when a foreign object like a metal is plugged into one of the sockets 11, the shutter 3 receives an unbalance force on the lug 31 to tilt the shaft of the shutter 3 so that the rib 332 on the shaft barrel 33 opposite the pressed lug 31 catches into the chamfer 212 of the thimble 21 to lock them together, the shutter 3 is not able to move, meanwhile the plugging way of the conducting pin 51 is blocked still so that the foreign object can not touch with the conducting strip 6. In this case, the gap between the guide pin 13 of the upper shell 1 and the guiding hole 334 of the shutter 3 is big enough to guaranty a space for tilting the shutter 3 to move the rib 332 into the chamfer 212 without any limitation.

Figure 9:
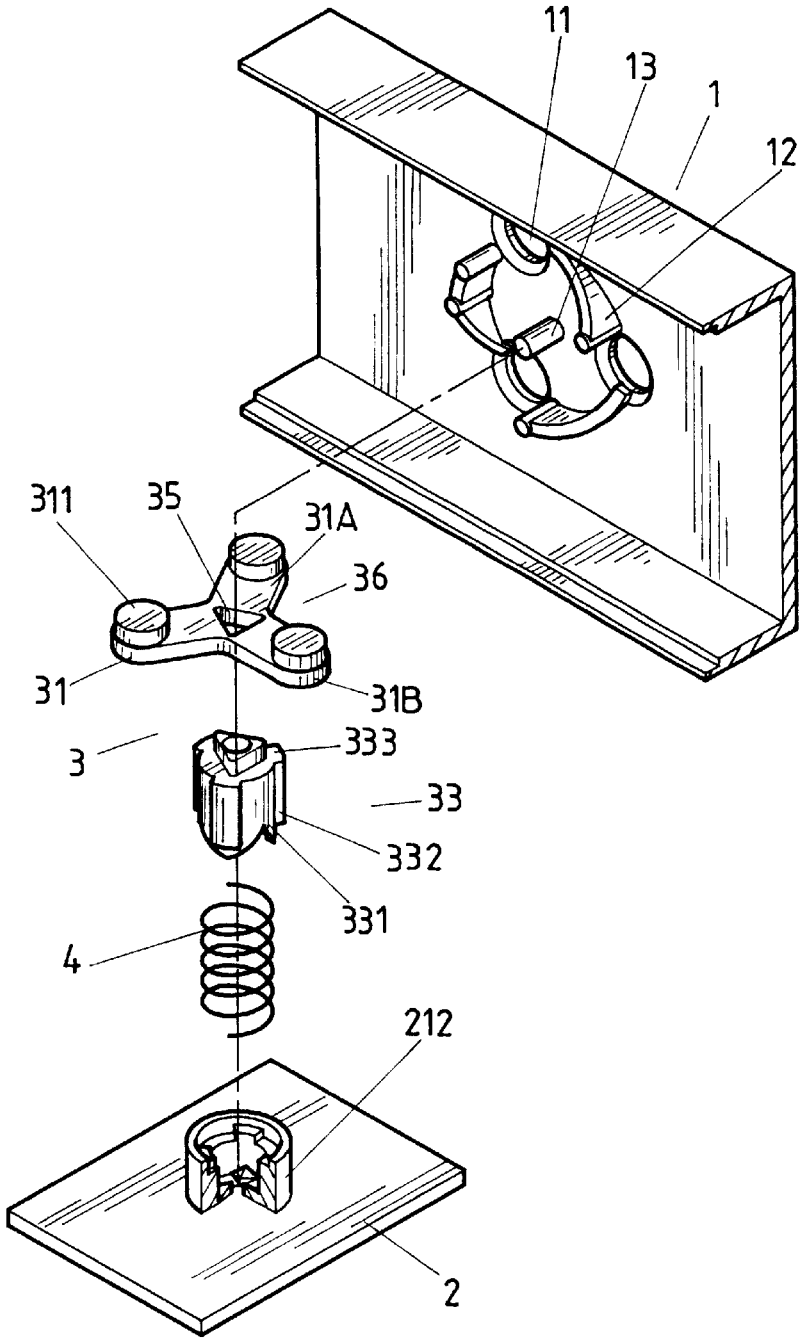
FIG. 9 is an exploded view showing the variation (1) of the present invention.

The other operations can be provided by the present invention, one of them, as shown on FIG. 9, is to provide a separate shutter 3 including an individual shutter plate 36 and an individual shaft barrel 33, in which the shutter plate 36 has a fixing aperture 35 at the centre portion, cooperating with a fixing nose 333 at the top end of the shaft barrel 33, to fix the shutter plate 36 and the shaft barrel 33 together. The other structures of which are the same as of the above-described.

Figure 10:
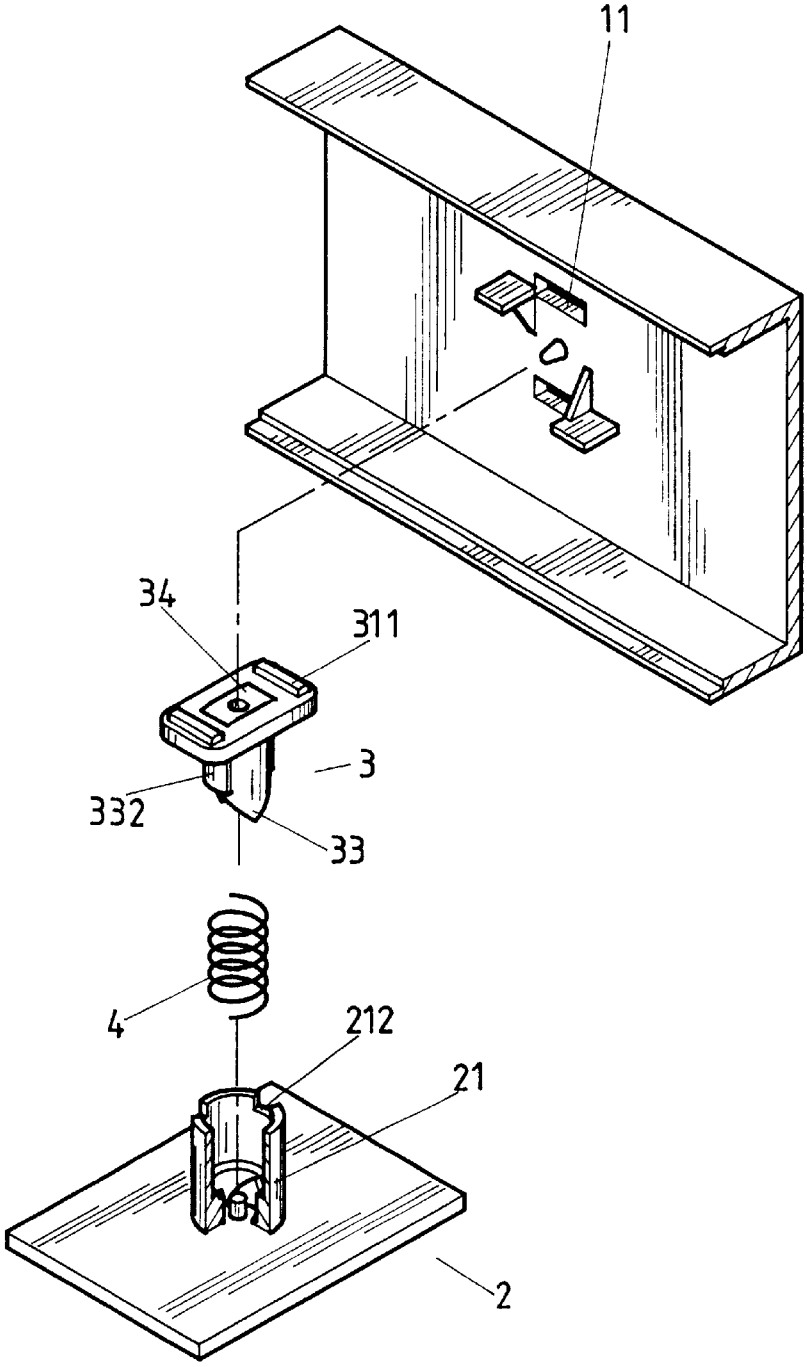
FIG. 10 is an exploded view showing the variation (2) of the present invention.
Figure 11:
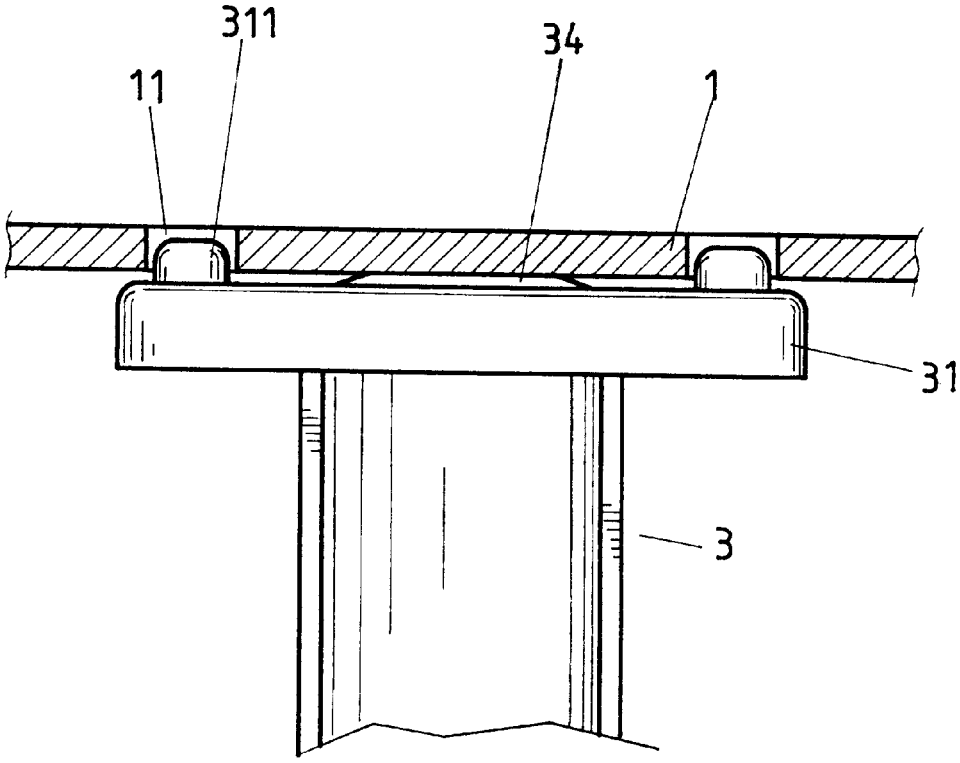
FIG. 11 is a part section view of the present invention.
Figure 13:
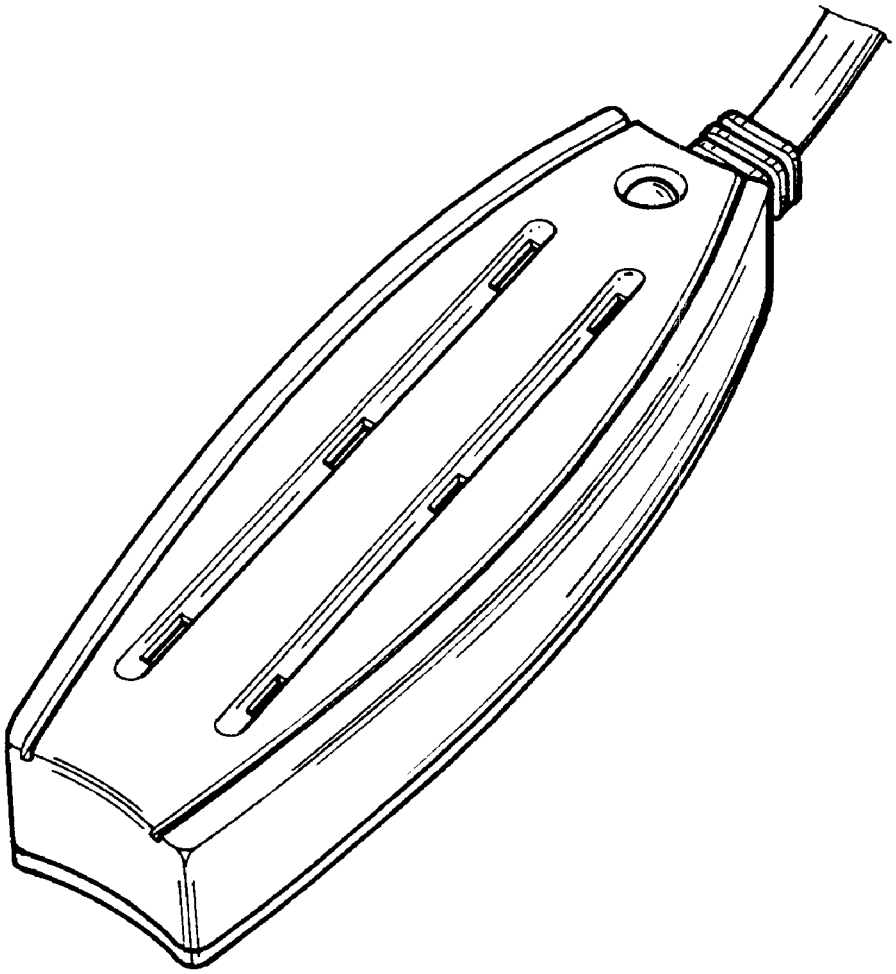
FIG. 13 is a solid view showing the second operation of the present invention.

The second operation, as shown on FIG. 10, FIG. 11 and FIG. 13, is used for the common two-pin plug, in which the shutter 3 has a rectangle plate co-ordinating to the sockets 11 with a pair of projections 311 blocking on the sockets 11, and a salience 34 formed on the top centre portion; in combining, as above-described, the spring 4, the shutter 3 and the upper shell 1 are mounted on the base 2 sequentially and respectively, the difference is that the salience 34 instead of the guide pin 13 and the guiding hole 334 touches against the upper shell 1 directly to provide a bigger freedom to the shutter 3 so that when it receives an unbalance force on one lug 31, the shutter 3 can be tilted around the fulcrum—the salience 34 to push the rib 332 into the chamfer 212 to lock the shutter 3 up.

Figure 12:
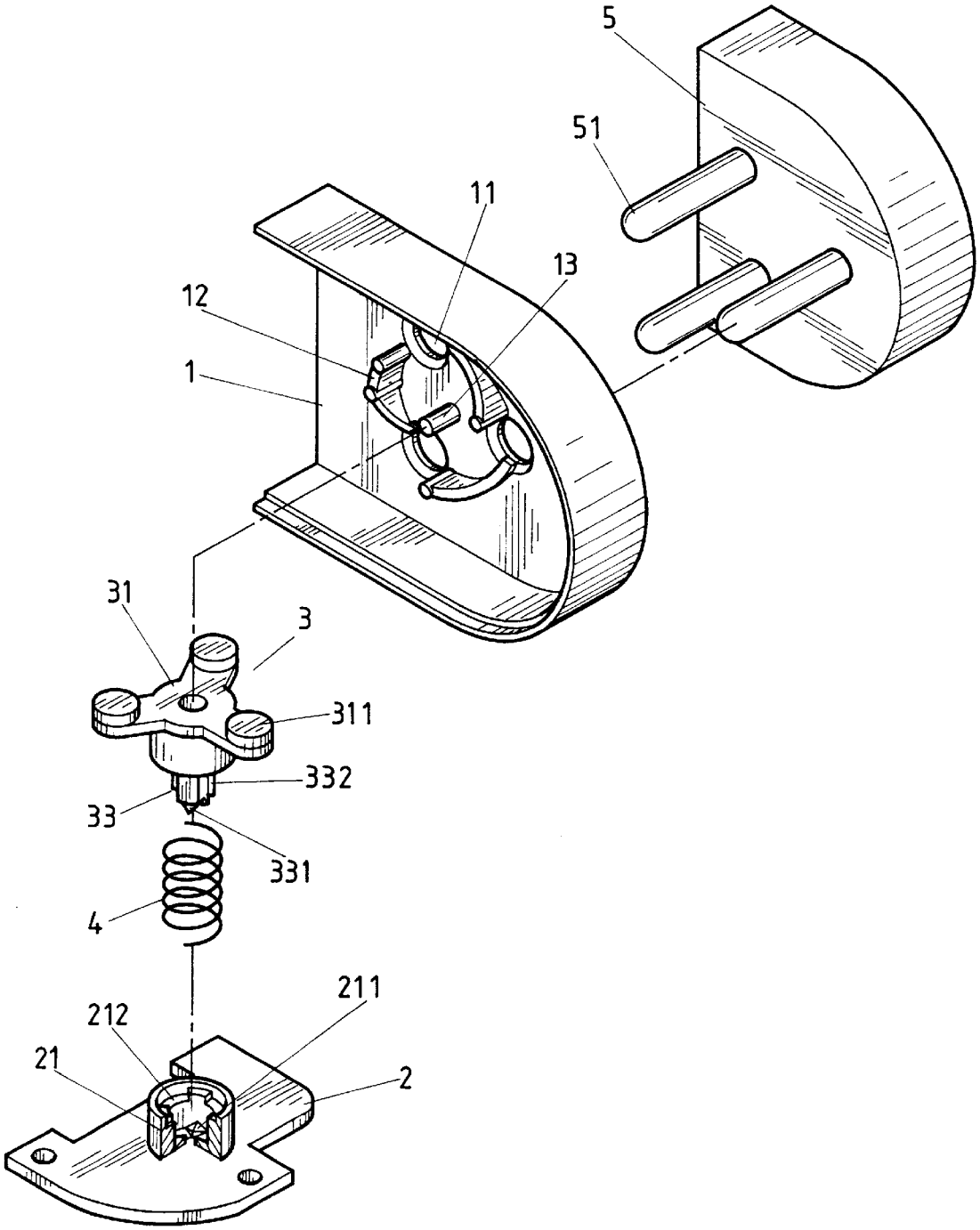
FIG. 12 is an exploded view showing the first operation of the present invention.
Figure 14:
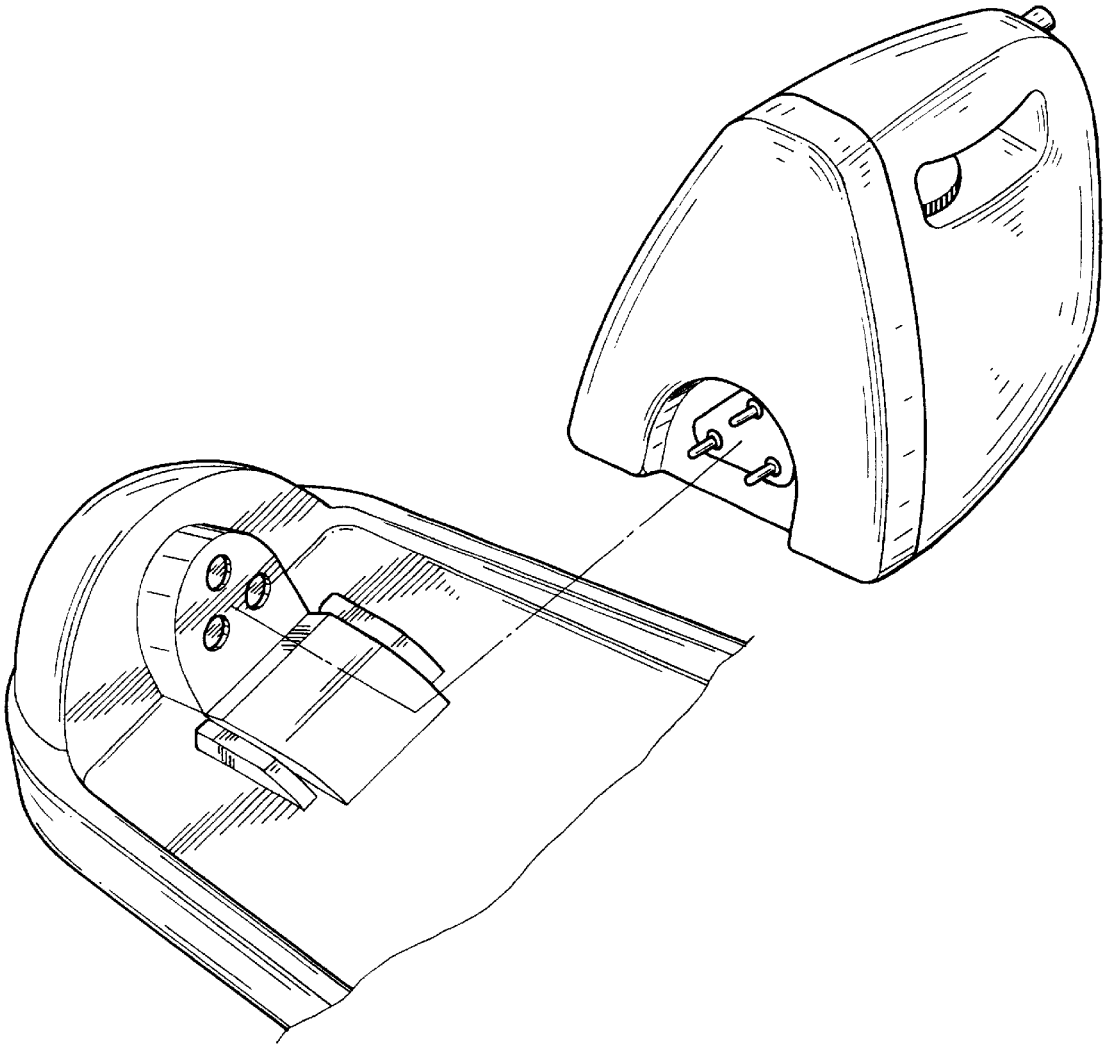
FIG. 14 is a solid view showing the third operation of the present invention.

Referring to FIG. 12 and FIG. 14, it is used for the common three-pin plug (a cordless steam iron for example), in which the upper shell 1 has three sockets 11 formed on the top face; the base 2 is shaped following the contour of the upper shell 1; and the shutter 3 has three lugs 31 with projections 311 on the top of end corresponding to the sockets 11 and a shaft barrel 33 with ribs 332 and several beveled guide teeth 331 at inside extending from the bottom side; the base 2 has a thimble 21 at the centre of the top side, and a set of axial beveled guide teeth 211 built on the inside of the thimble 21, and several axial chamfers 212 formed at the proper positions on the rim of the thimble 21 co-ordinating with the ribs 332 of the shutter 3; in combining, the shutter 3 with the spring 4 is contained into the case consisting of the upper shell 1 and the base 2, as it receives an unbalance force on one lug 31, the shutter 3 is tilted to make the rib 332 on the shaft barrel 33 lock in the chamfer 212 of the thimble 21.

I claim:

1. A shutter structure of an aperture comprising:

a base shell having an interior surface;

a thimble fixedly mounted on said interior surface of said base shell, said thimble having an inner rim with a plurality of chamfers formed on said inner rim, said thimble having a first set of axially beveled guide teeth formed within an interior volume of said thimble;

a pair of conducting strips fixedly secured to said base shell;

a spring having a first end inserted within said interior volume of said thimble;

a shutter member having opposing upper and lower surfaces, said shutter member having a hollow cylinder extending from a central portion of said lower surface having an interior cylindrical volume and said hollow cylinder being in contact with a second end of said spring, said shutter member having at least one projection formed on said upper surface;

a shaft barrel extending from said central portion of said lower surface and mounted within said interior cylindrical volume of said hollow cylinder, said shaft barrel having a circumferential surface and a lower shaft surface, said circumferential surface having a plurality of strip ribs formed thereon, said plurality of strip ribs formed to mate with said plurality of chamfers formed on said inner rim of said thimble whereby when an unbalanced force is applied to said shutter member at least one of said strip ribs engages with a respective one of said chamfers and rotatingly locks said shutter member;

a second set of beveled guide teeth formed on said lower surface of said shaft barrel;

an upper shell overlaying said base shell and affixed thereto, said upper shell having a plurality of sockets for receiving conducting pins of an electrical plug therein, each of said sockets being located in aligned relationship with a respective one of said projections of said shutter member for initiating a rotation of said shutter member when insertion of said conducting pins into said sockets causes contact between said first set of beveled guide teeth and said second set of beveled guide teeth, whereby contact and subsequent lateral movement of said second set of beveled guide teeth with respect to said first set of beveled guide teeth causes a rotation of said shutter member to provide a path for said conducting pins to electrically contact said pair of conducting strips.

2. The shutter structure of an aperture as recited in claim 1, wherein said shutter member includes a shutter plate releasably coupled and separable from said shaft barrel, wherein said shutter plate has a fixing aperture formed at a center region, and said shaft barrel has a fixing nose at a top end for fitting into said fixing aperture of said shutter plate.

3. The shutter structure of an aperture as recited in claim 1, wherein said shutter member has a salience located at a center top face and projecting from said center top face for providing a gap between said top face of said shutter member and a bottom side of said upper shell.

4. The shutter structure of an aperture as recited in claim 2, wherein said shutter member has a salience at the said center top face and projecting from said center top face for providing a gap between said top face of said shutter member and the said bottom side of said upper shell.

* * * * *